US009539608B2

(12) United States Patent
Kenney

(10) Patent No.: US 9,539,608 B2
(45) Date of Patent: Jan. 10, 2017

(54) PAINT ROLLER

(71) Applicant: John A. Kenney, Oklahoma City, OK (US)

(72) Inventor: John A. Kenney, Oklahoma City, OK (US)

( * ) Notice: Subject to any disclaimer, the term of this patent is extended or adjusted under 35 U.S.C. 154(b) by 289 days.

(21) Appl. No.: 14/206,122

(22) Filed: Mar. 12, 2014

(65) Prior Publication Data

US 2014/0189972 A1 Jul. 10, 2014

Related U.S. Application Data

(60) Provisional application No. 61/790,038, filed on Mar. 15, 2013.

(51) Int. Cl.
*B05C 17/02* (2006.01)

(52) U.S. Cl.
CPC ..... *B05C 17/0207* (2013.01); *B05C 17/02* (2013.01)

(58) Field of Classification Search
CPC ... B05C 17/0207; B05C 17/02; B05C 17/0215
USPC ..... 15/230.11; 492/13, 19
See application file for complete search history.

(56) References Cited

U.S. PATENT DOCUMENTS 2,761,167 A * 9/1956 Bridgford ..... B05C 17/0207 15/230.11
2,866,995 A * 1/1959 Evensen ..... B05C 17/0207 15/181
3,119,137 A * 1/1964 Schueler ..... B05C 17/02 15/230.11
3,433,693 A * 3/1969 Evensen ..... B05C 17/0207 156/242
3,986,226 A * 10/1976 Roe ..... B05C 17/0217 15/230.11
4,077,082 A 3/1978 Roe et al.
4,107,815 A 8/1978 Dumesnil
4,217,737 A 8/1980 Hasegawa
4,537,522 A 8/1985 Charney et al.
5,490,303 A * 2/1996 Graves ..... B05C 17/02 15/230.11
5,980,802 A 11/1999 Wakat et al.
5,983,437 A * 11/1999 Wakat ..... B05C 17/0207 15/230.11
5,996,166 A 12/1999 Shehow
6,101,662 A * 8/2000 Polzin ..... B05C 17/02 15/230.11

(Continued)

FOREIGN PATENT DOCUMENTS

DE WO 9521704 A1 * 8/1995 ..... B05C 17/0207
FR 2923402 11/2007
WO 9521704 A1 8/1995

OTHER PUBLICATIONS

PCT/US2014/042084, Kenney, International Search Report dated Oct. 29, 2014.

*Primary Examiner* — Joseph J Hail
*Assistant Examiner* — Marc Carlson
(74) *Attorney, Agent, or Firm* — McAfee & Taft, PC

(57) ABSTRACT

The disclosure describes an improved paint roller wherein ribs are incorporated into either the roller core or the nap. Alternatively, the improved paint roller may use individual ribs positioned between the roller core and the nap. The incorporation of ribs into the roller core/nap assembly improves application of coating material to the nap and subsequent transfer of coating material to a surface.

20 Claims, 12 Drawing Sheets

(56) References Cited

U.S. PATENT DOCUMENTS

| | | | | |
|---|---|---|---|---|
| 6,405,404 | B2 * | 6/2002 | Babkowski | B05C 17/02 15/230.11 |
| 6,721,988 | B2 * | 4/2004 | Woodruff | B05C 17/02 15/230.11 |
| 7,682,686 | B2 * | 3/2010 | Curro | A61F 13/00 428/156 |
| 2002/0028103 | A1 * | 3/2002 | Frank | A46B 11/063 401/197 |
| 2002/0042331 | A1 * | 4/2002 | Fortner | B05C 17/02 492/13 |
| 2002/0073500 | A1 * | 6/2002 | Pavlou | B05C 17/02 15/230.11 |
| 2010/0139559 | A1 * | 6/2010 | Scott, Sr. | B05C 17/02 118/258 |
| 2010/0218719 | A1 * | 9/2010 | Belley | B05C 17/02 118/258 |
| 2015/0020328 | A1 * | 1/2015 | Palushaj | B05C 17/0207 15/104.001 |

* cited by examiner

PAINT ROLLER

BACKGROUND

Paint rollers are common, well-known tools used to apply coatings to walls, ceilings and other structures. In the most basic terms, a paint roller includes a handle, a frame, a rotating cage carried by the frame and a tube like roller core carried by the rotatable cage. Positioned on the roller core is a nap suitable for absorbing and transferring coating material.

In normal use, a person applies paint or other coating material to the nap by rolling the nap through a pan tray or other container holding the coating material then transfers the coating material to the desired surface by rolling the nap over the surface. Unfortunately, some coatings are not readily absorbed by the nap. As a result, the nap does not readily pickup coating material from a roller tray. If the nap does not generate sufficient friction with the pan to roll evenly, the roller will slide through the roller tray precluding even distribution of the coating material around the roller nap. Further, some coatings have a consistency that precludes constant smooth rotation of the roller core during application of the coating to the surface. The inconsistent or uneven application of coating material to the nap and inconsistent rolling of the nap/roller core during application to a surface produces a coating of inconsistent thickness and quality on the desired surface and/or can require unnecessary time to apply properly.

Additionally, roller applicators commonly used to apply surface coatings such as paint and other liquid material, do not readily absorb higher density materials in the roller nap. When transferring such coating material to the roller applicator, the nap does not produce sufficient friction with the surface of the container to allow the roller to roll through the coating material.

SUMMARY

The present invention provides an improved paint roller. The paint roller comprises a roller core and a nap with at least one rib. The rib may be carried by the roller core, positioned between the roller core and the nap, positioned within a groove or an open slot formed in the roller core or embedded in the nap. Additionally, the rib may deflect or extend into the nap.

DETAILED DESCRIPTION

Figure 22:
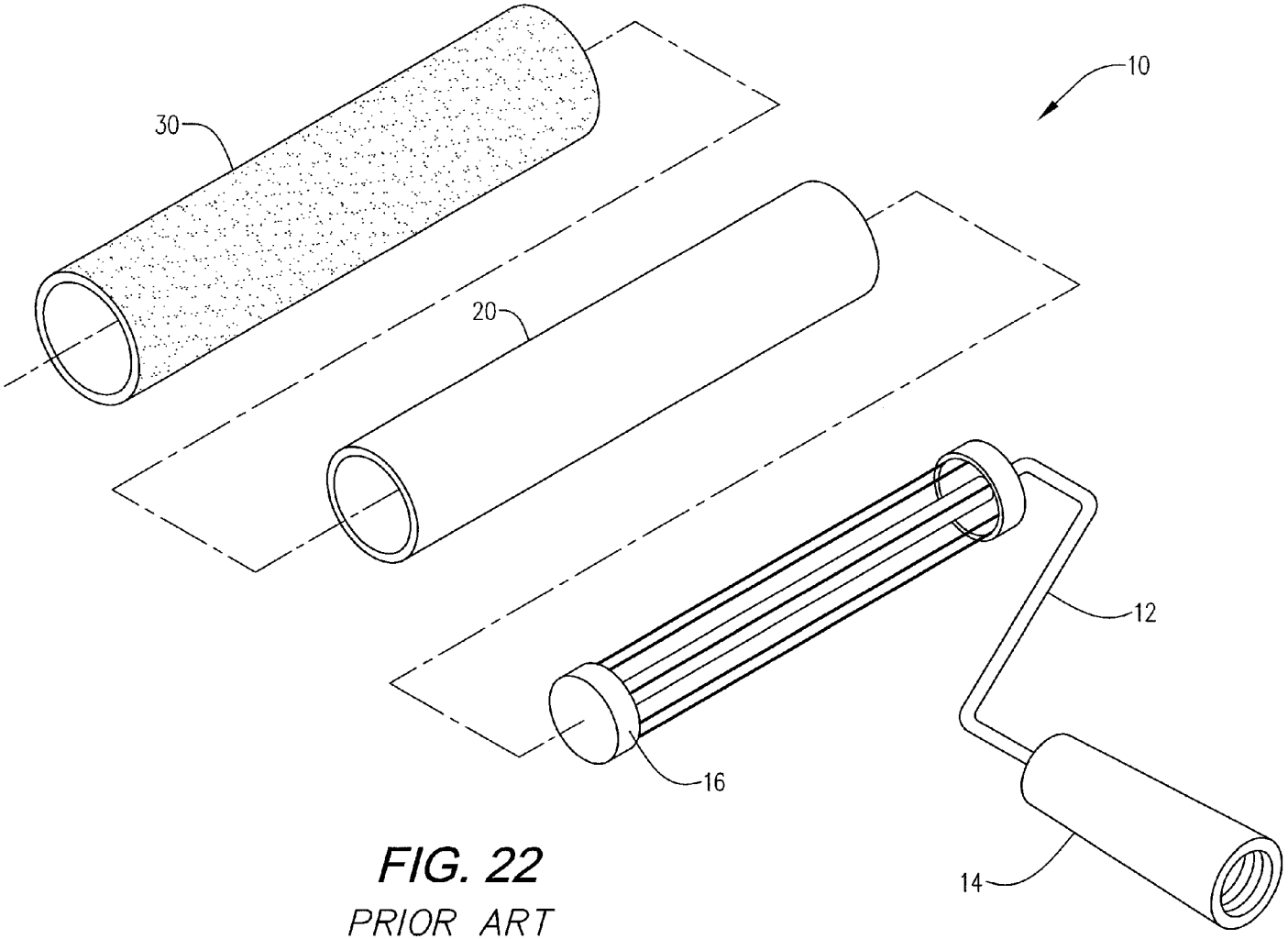
FIG. 22 PRIOR ART
FIG. 22 depicts a disassembled conventional prior art paint roller with a conventional roller cover and a conventional nap.

The present invention relates to improvements in the outer surface of the roller core. As depicted in the FIG. 22, paint roller 10 has a frame 12 with a handle 14 and rotatable cage 16 carried by frame 12. Cage 16 carries a roller core 20 with a nap 30 positioned over roller core 20. Alternative embodiments of cage 16 are known to those skilled in the art. Roller core 20 may be manufactured from any suitable material capable of carrying nap 30 and functioning in the desired environment.

Figure 9:
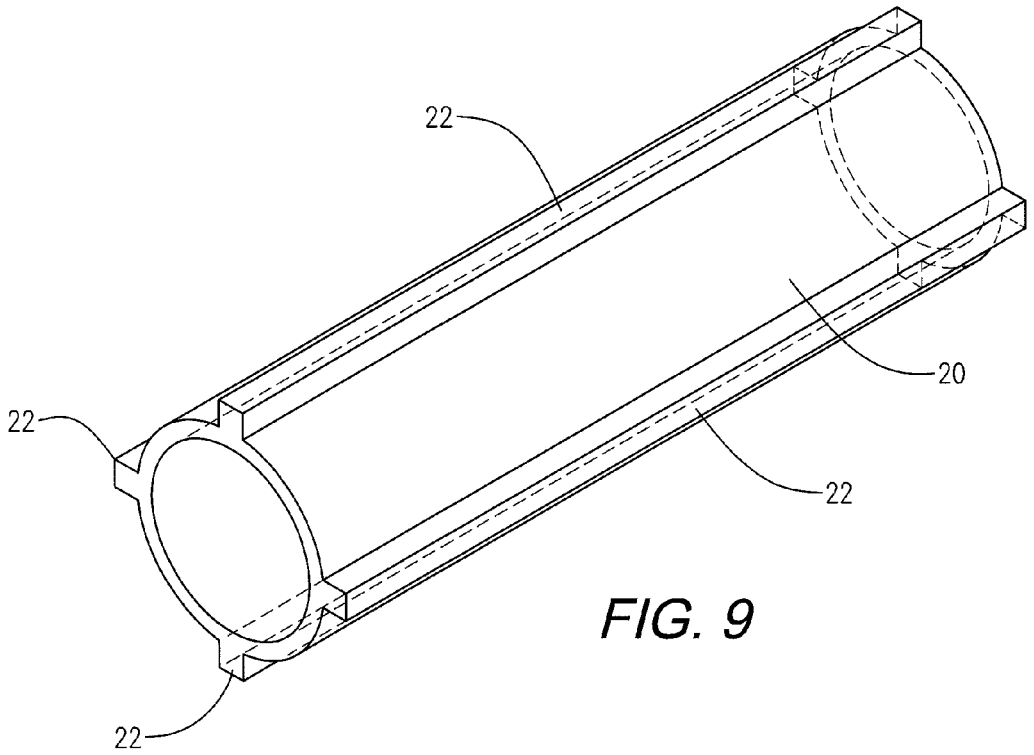
FIG. 9 depicts an alternative embodiment of the improved roller core wherein the core carries four transverse ribs evenly spaced about the circumference of the core.
Figure 10:
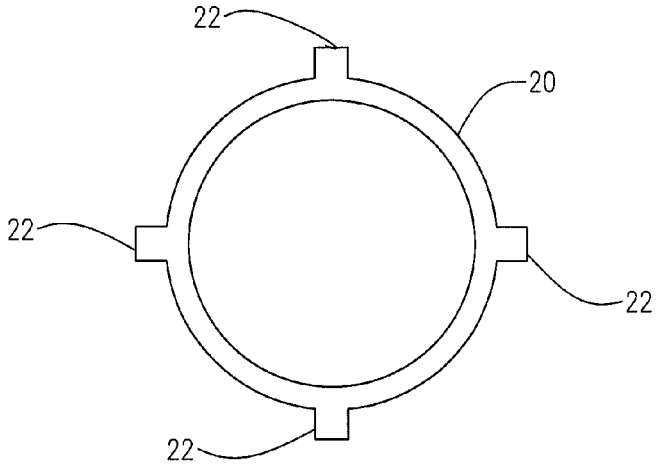
FIG. 10 depicts an end view of the roller core of FIG. 9.
Figure 11:
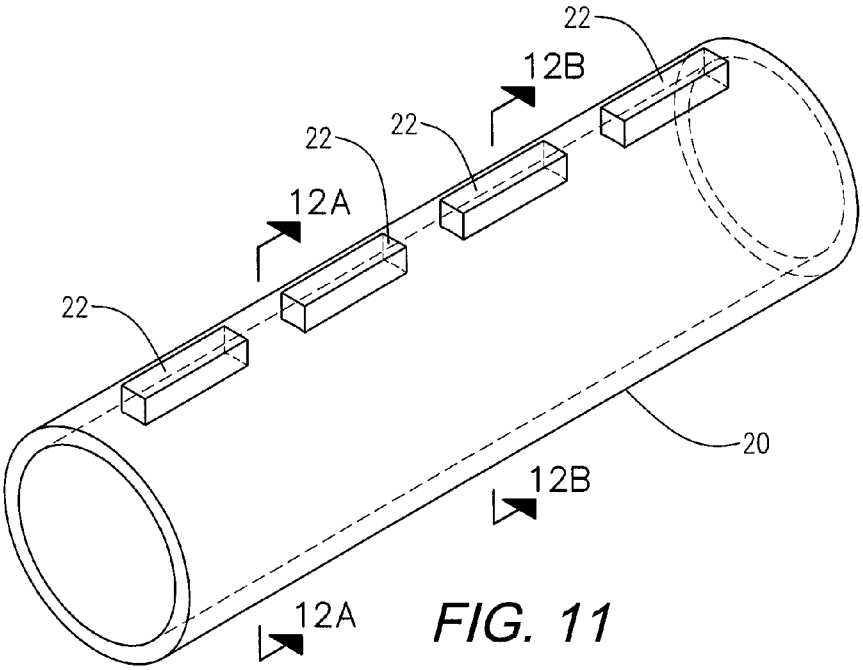
FIG. 11 depicts an alternative embodiment wherein the transverse ribs are discontinuous.
Figure 12A:
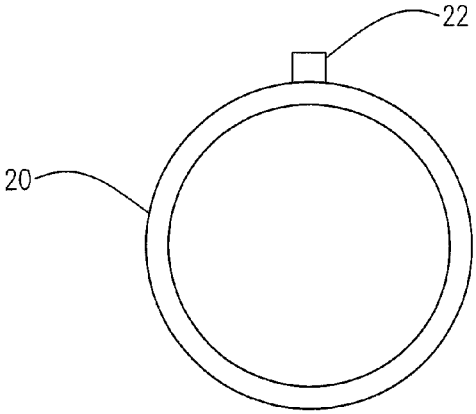
FIG. 12A is a sectional view of FIG. 12 taken along line 12A-12A where line 12A-12A does not intersect a rib portion.
Figure 12B:
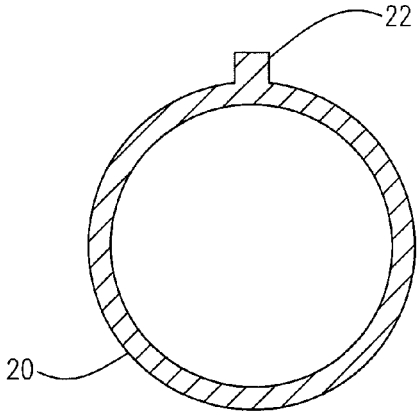
FIG. 12B is a sectional view of FIG. 12 taken along line 12B-12B where line 12B-12B does intersect a rib portion.
Figure 13:
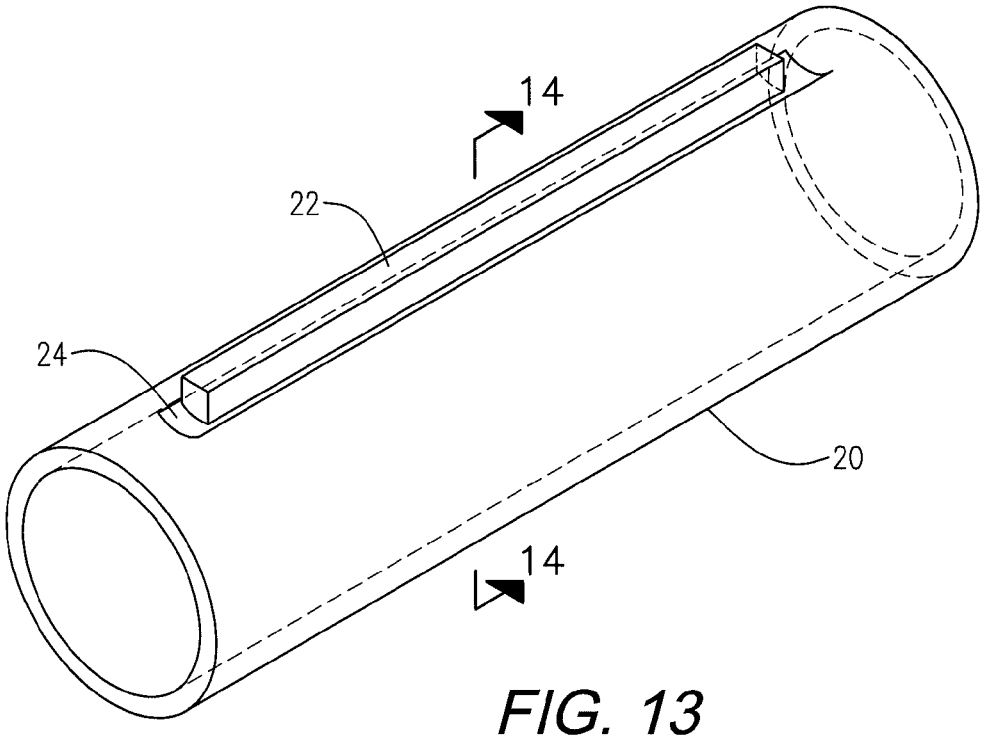
FIG. 13 depicts an alternative embodiment wherein the transverse ribs do not extend the entire length of the roller core and wherein the transverse rib is positioned within a groove.
Figure 17:
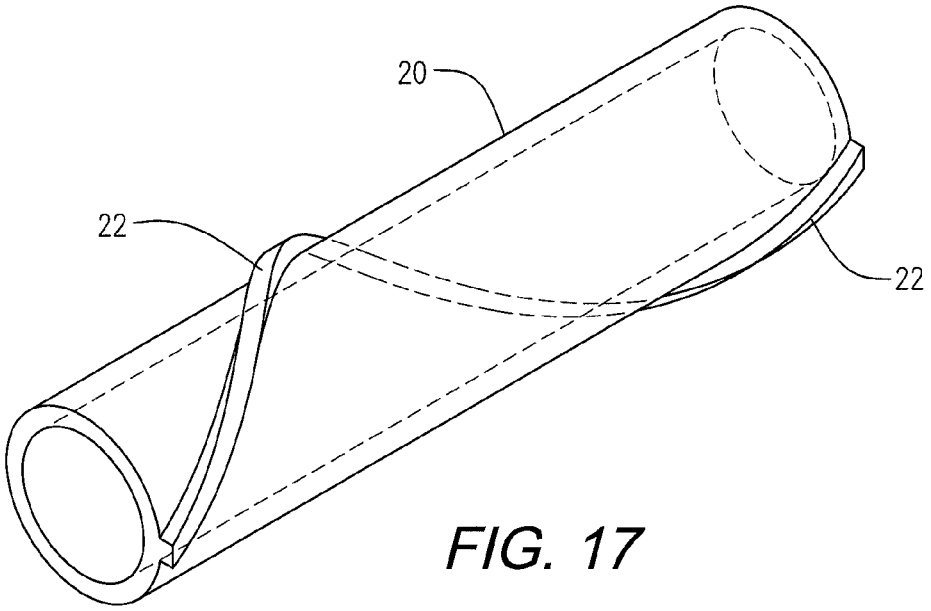
FIG. 17 depicts an alternative embodiment wherein the rib spirals around the core.

In one embodiment of the current invention as depicted in FIGS. 1-12, the exterior surface of roller core 20 carries at least one transverse rib 22. As used herein, transverse refers to a direction generally parallel to the central axis of roller core 20. In another embodiment as depicted in FIG. 11, rib 22 may be a series of discrete protrusions running transversely from one end of roller core to another. FIG. 13 depicts another embodiment wherein rib 22 traverses only a portion of the surface of roller core 20. The partial rib 22 may be integral with roller core 20 or a discrete member. In the embodiment of FIG. 13, roller core may carry one or more reduced length ribs 22. Further, in the embodiment of FIG. 13 ribs 22 may be in the form of a series of protrusions such as depicted in FIG. 11. FIG. 17 depicts yet another embodiment wherein one or more ribs 22 spiral around the body of roller core 20. The spiral defined by ribs may extend only across a portion of the axial length of roller core 20 or may extend from one edge to the other edge of roller core 20.

Figure 18:
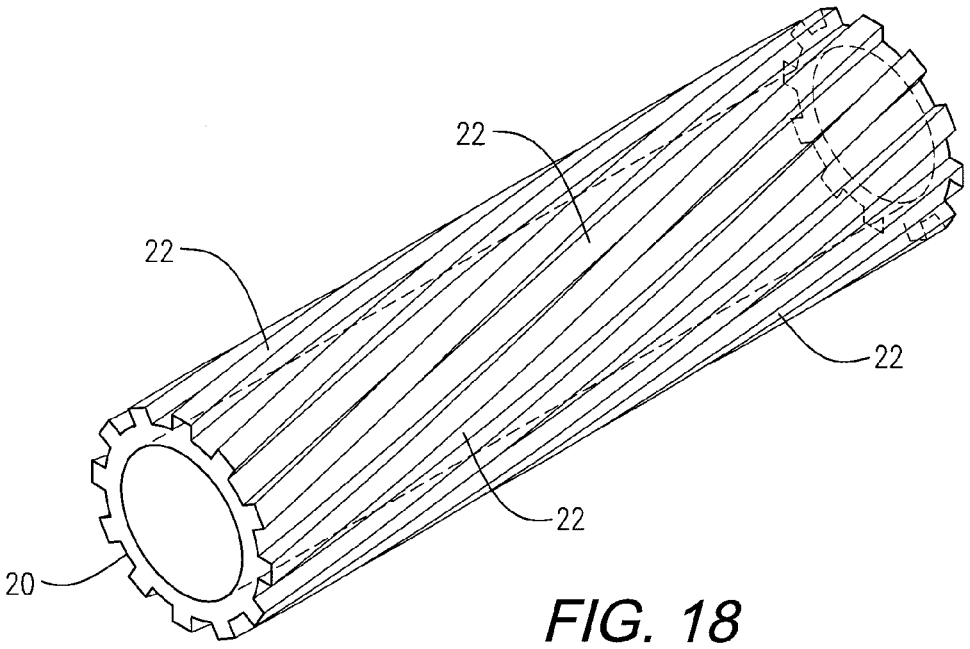
FIG. 18 depicts an alternative embodiment wherein the ribs are positioned on a bias along the length of the roller core.

As in FIG. 11, spiraling ribs 22 may be a series of protrusions. Further, as depicted in FIG. 18, ribs 22 may run on a bias around roller core 20 as opposed to transversely running the length of core 22. Again, ribs 22 positioned on a bias may be a series of protrusions. When angled on a bias, ribs 22 will generally define an angle of about 10° to about 45° from the central axis of roller core 20.

Figure 3:
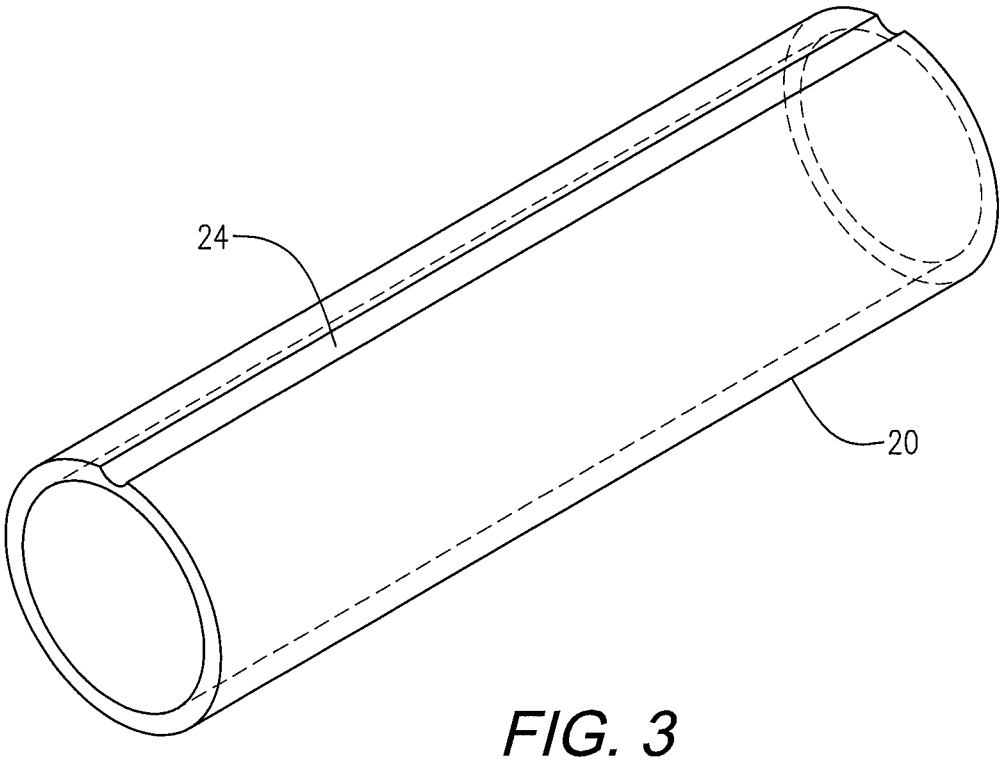
FIG. 3 depicts an alternative embodiment where the roller core carries a transverse groove configured to receive and retain a rib when a nap is placed over the core.
Figure 4:
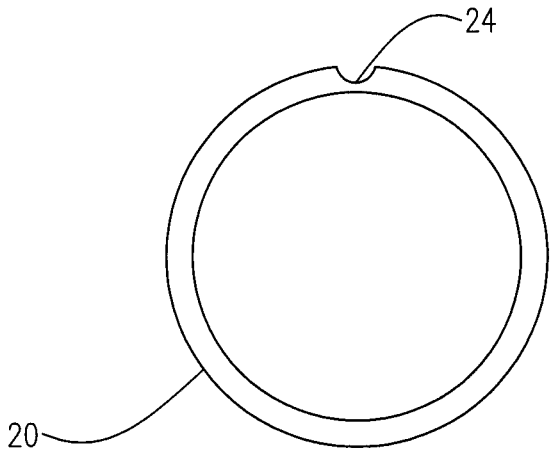
FIG. 4 depicts an end view of the roller of FIG. 3.
Figure 14:
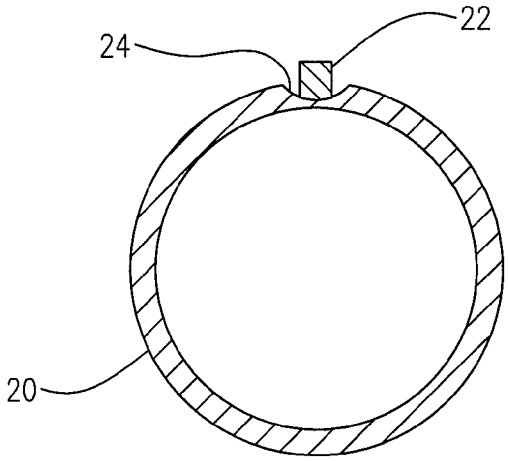
FIG. 14 is a sectional view of FIG. 13 taken along line 14-14 showing the rib within the groove.
Figure 15:
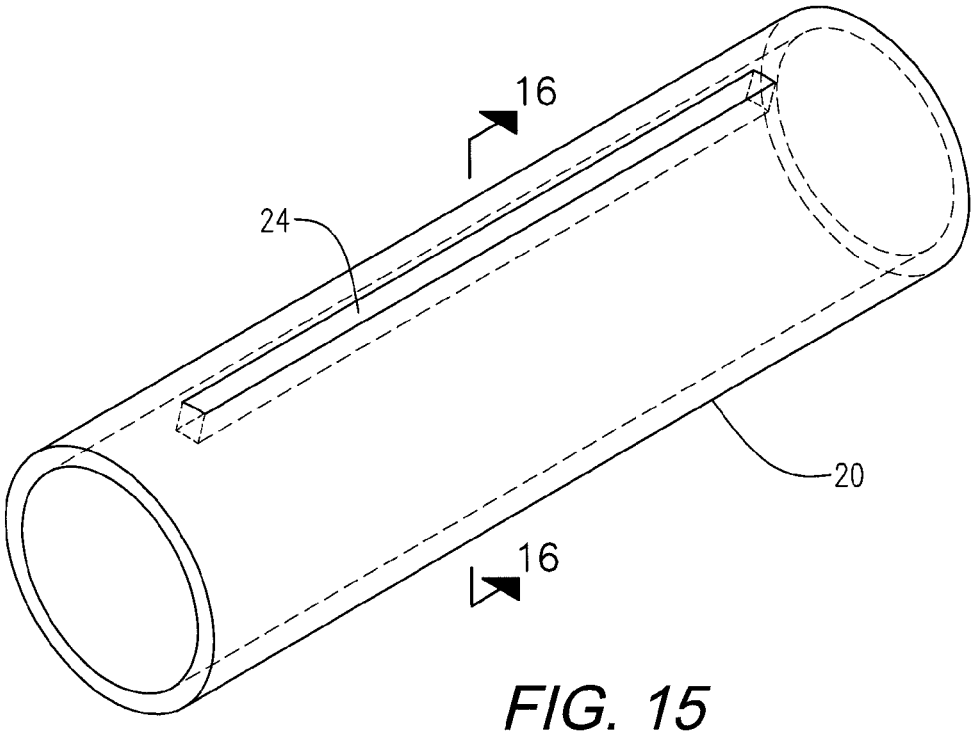
FIG. 15 depicts a slot in the roller core configured at a non-perpendicular angle to the surface, i.e. the slot does not align with a radial extending from the axis of the roller core.
Figure 16:
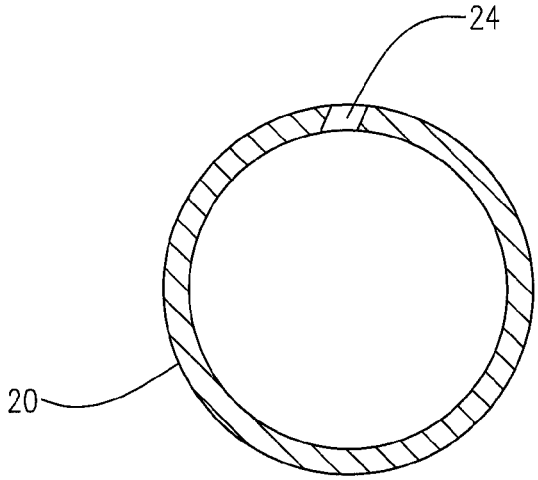
FIG. 16 is a sectional view of FIG. 15 taken along line 16-16.
Figure 19:
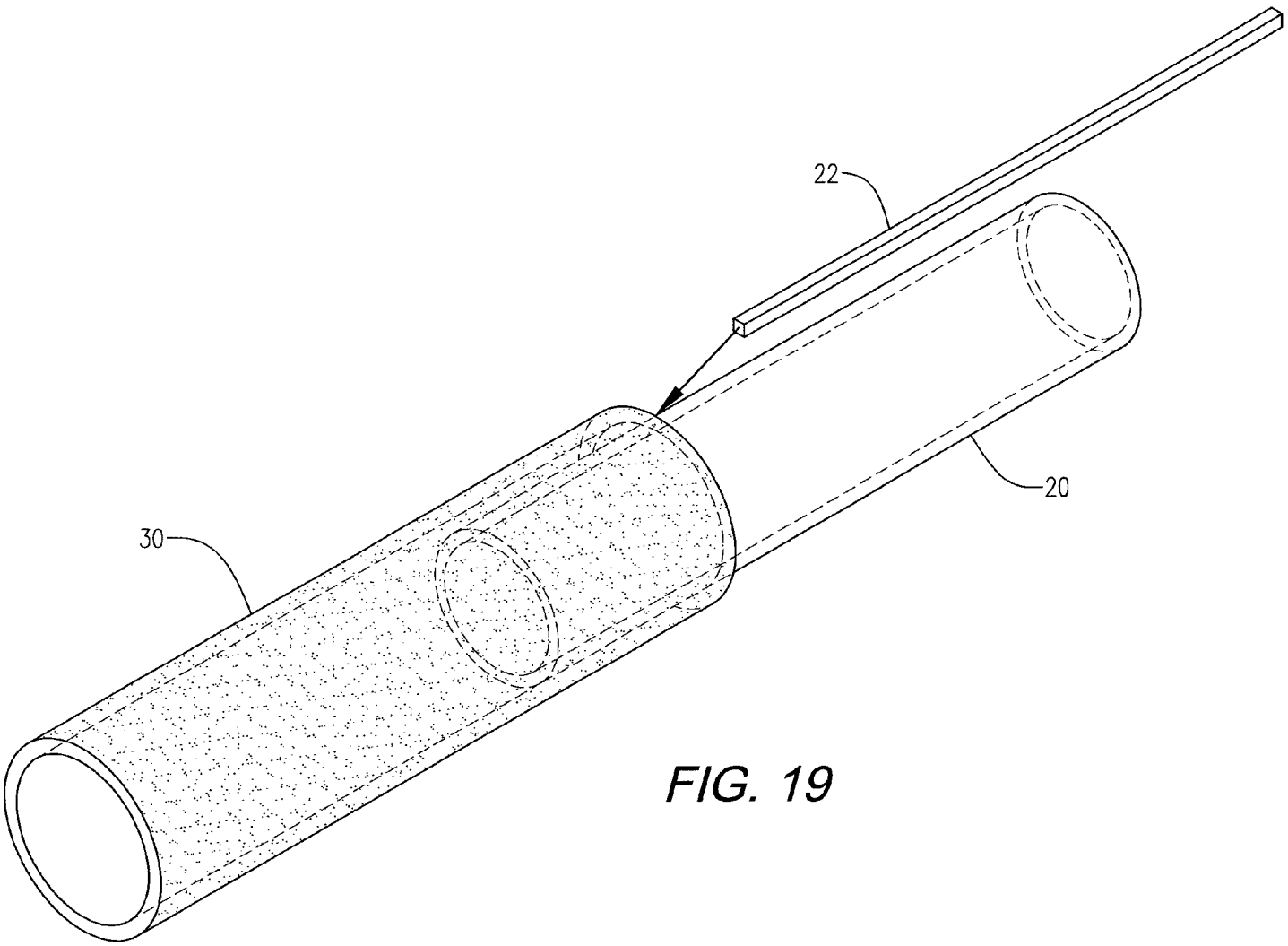
FIG. 19 depicts an alternative embodiment where the rib is an insert positioned between the nap and the roller core.

In another embodiment as depicted in FIG. 19, rib 22 is not incorporated into or secured to roller core 20. Rather, as depicted in FIG. 19, rib 22 is a discrete component. As depicted in FIG. 19, rib 22 will be slipped between nap 30 and roller core 20. Preferably, two or more ribs 22 will be slipped or positioned between nap 30 and roller core 20. Typically, four ribs 22 will be positioned at ninety-degree intervals around roller core 20 and held in place by nap 30. Additionally, as depicted in FIGS. 3, 13-14, to aid positioning of rib 22, roller core 20 may also include grooves or open slots 24, as depicted in FIGS. 15-16, configured to receive rib 22. Grooves or slots 24 may position rib 22 in alignment with a radial line extending from the axis of roller core 20. However, in another embodiment, grooves or open slots 24 support rib 22 in a manner such that rib 22 is position at a non-perpendicular angle to the surface of roller core 20. In other words, open slots or grooves support rib 22 in a manner such that the angle of rib 22 relative to the axis of roller core 20 that does not correspond to a radial line extending from the axis of core 20 to the surface of core 20.

Additionally, FIGS. 15-16 depict an embodiment wherein rib 22 is received within a slot 24. In these embodiments, rib 22 may be a flexible member passing through slot 24 and extending above the surface of roller core 20. Rib 22 may pass through slot 24 and extend into the interior of roller core 20 and will extend above the surface of roller core 20. Additionally, whether slot 24 is aligned such that rib 22 corresponds with a radial extending from the axis of roller core 20 or slot 24 is configured to support rib 22 at an angle different from a radial extending from the axis of roller 20, rib 22 will preferably be a flexible element capable of flexing during rotation of roller core 20 over a surface. When slot 24 supports rib 22 at an angle different from a radial line extending from the axis of roller core 20, rib 22 will extend above the surface of roller core 20 at an angle tangential to the surface, i.e. non-perpendicular to the surface. Similarly, groove 24 may be configured to support rib 22 at a perpendicular angle to the surface of roller core 20. Alternatively, groove 24 may be configured to support rib 22 at an angle different from a radial line extending from the axis of roller core 20, i.e. at an angle tangential to the surface of roller core 20. Further, ribs 22 may be located centrally within the thickness of nap 30 or as depicted in FIGS. 20-21, at the interior or exterior surface of nap 30.

Figure 1:
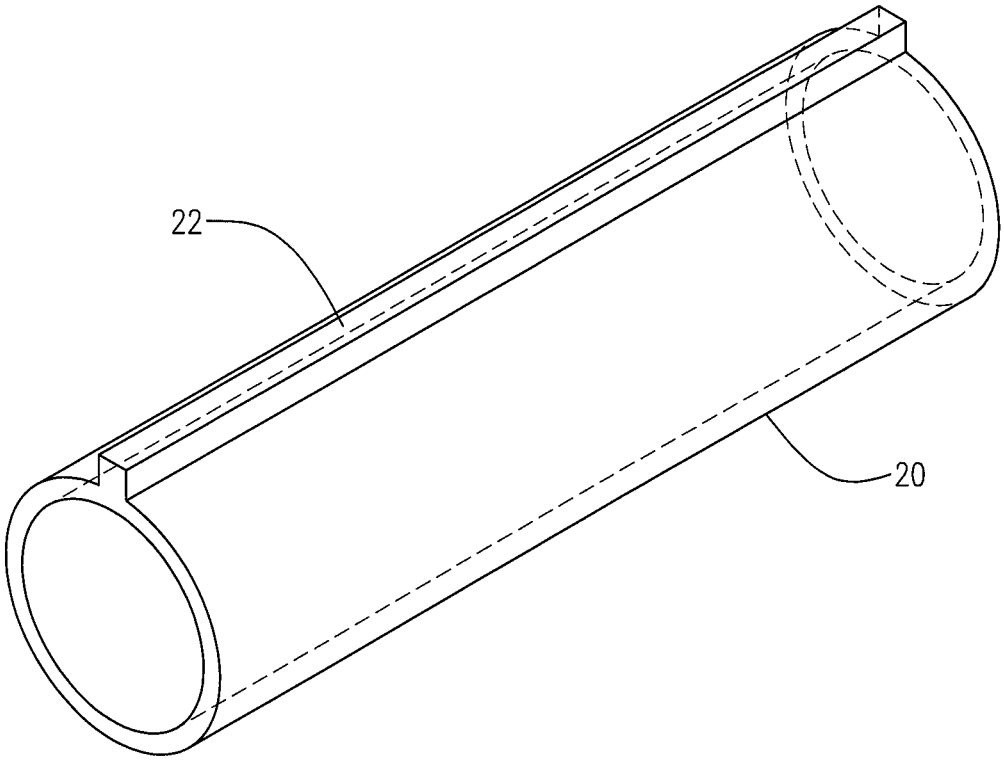
FIG. 1 depicts an improved roller core having a transverse rib running from one end to the other end of the roller.
Figure 2:
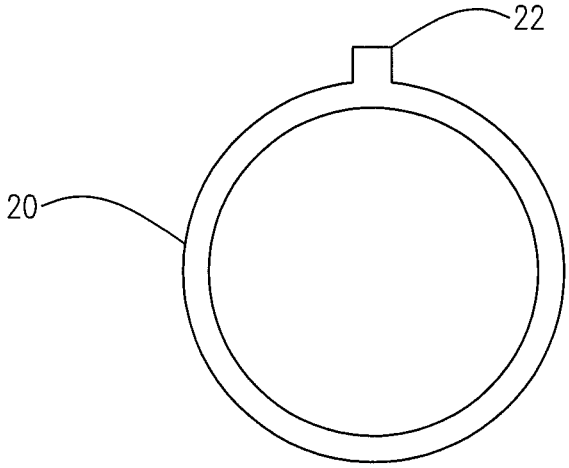
FIG. 2 depicts an end view of the roller core of FIG. 1.
Figure 5:
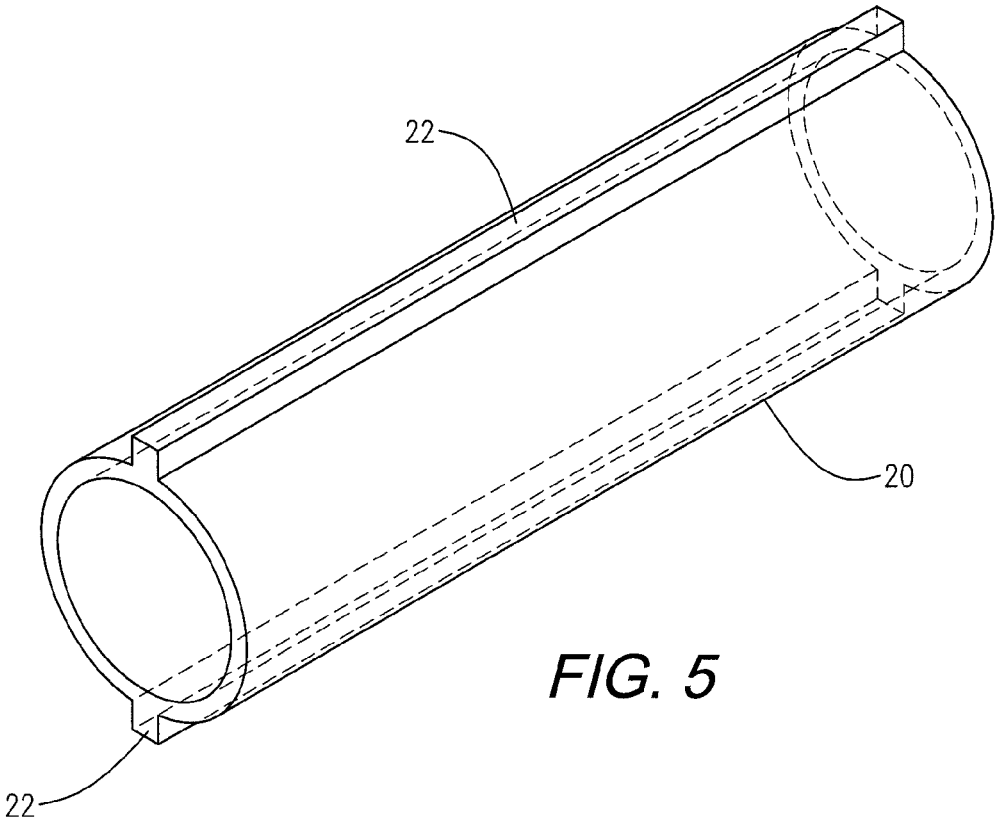
FIG. 5 depicts an alternative embodiment of the improved roller core wherein the core carries two transverse ribs evenly spaced about the circumference of the core.
Figure 6:
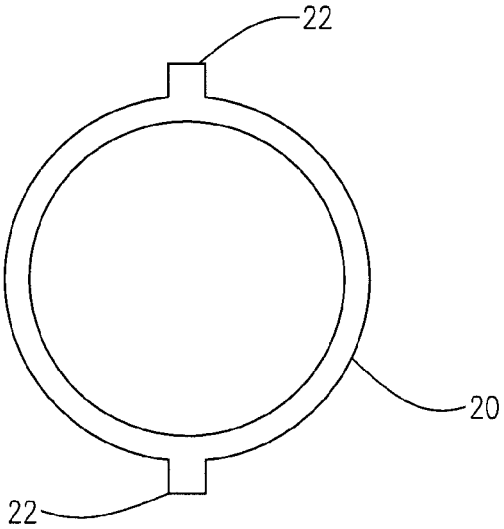
FIG. 6 depicts an end view of the roller core of FIG. 5.
Figure 20:
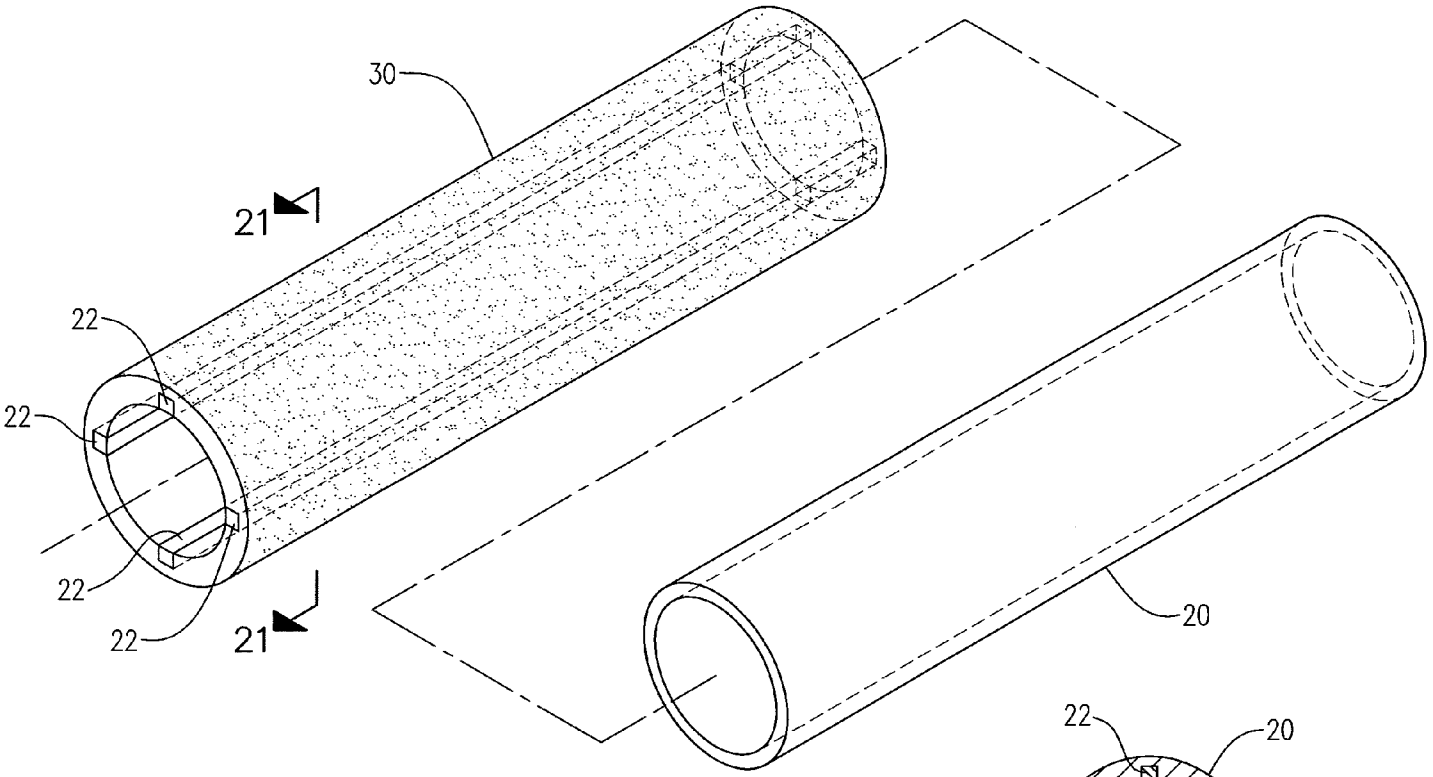
FIG. 20 depicts an alternative embodiment where the rib is a component of the nap and the nap is placed over the roller core.
Figure 21:
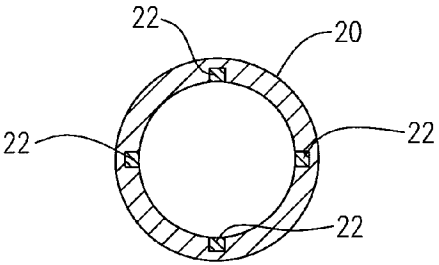
FIG. 21 is sectional view of the nap taken along line 21-21.

In another embodiment as depicted in FIG. 20-21, rib 22 is incorporated into nap 30. For example, rib 22 may be woven into nap 30 or molded into nap 30. This embodiment is particularly useful when 10 has a frame 14 with an integral roller core 10 combined with or in place of cage 16. As depicted in FIG. 20-21, four ribs 22 are to the interior of nap 30. Thus, ribs 22 are shown for the most part in hidden line format. However, as depicted in FIGS. 1 and 5 fewer than four ribs 22 may be used in this embodiment.

Whether in the form of continuous or discontinuous protrusions, rib 22 described above may be a rigid material, a rigid yet flexible material or a compressible material. Additionally, ribs 22 may be prepared from a material capable of flexing back and forth as roller 10 moves back and forth over a surface. In general, rib 22 will be a non-absorbent material. So long as the composition of rib 22 is compatible with the coating to be applied any absorbent or non-absorbent material satisfying the rigidity, flexibility and compressibility requirements may be used. Ribs 22 integral with roller core 20 may be formed during construction of roller core 20. For example, injection molding processes will be capable of forming a roller core 20 with integral ribs 22. Alternatively, any convenient mechanism may be used to secure ribs 22 to roller core 20, within open slots or grooves 24 or between roller core 20 and nap 30. Suitable methods include, but are not limited to, the use of adhesives and connectors such as staples to secure ribs 22 to roller core 20. Alternatively, the fit of nap 30 may be sufficiently tight to permit insertion and retention of ribs 22 between nap 30 and roller core 20 as depicted in FIG. 19.

When using a rigid material or a flexible but non-compressible material, rib 22 will have a height extending from roller core 20 from about 10% to 25% of the thickness of nap 30. Typically, rigid or flexible but non-compressible rib 22 have a height of about 1/32 inch to about 1.5 inches, and preferably from about 1/16 inch to about 1 inch, and more preferably from about 1/8 inch to about 1/2 inch. Although each rib 22 on roller core 20 is depicted in the Figures as having identical dimensions, ribs 22 carried by a single roller core 20 may differ in height, width, length and geometry on roller core 20.

When using a compressible material, rib 22 will have a height extending from roller core 20 from about 10% to 100% of the thickness of nap 30. Typically, compressible rib 22 will have a have a height of about 1/8 inch to about 1 1/2 inches, and preferably from about 1/16 inch to about 1 inch.

The cross-section configuration of ribs 22 may be any regular or irregular geometric shape such as, but not limited to rectangular, oval, scalloped, trapezoidal or rounded. When present as discontinuous protrusions in a line, ribs 22 may be any regular or irregular geometric shape including, but not limited to, cubes, spheres, conical and frusto-conical objects.

The preferred embodiment will have a sufficient number of ribs 22 to enhance rolling of roller core 20 with nap 30 through a paint tray. As known to those skilled in the art, paint rollers frequently slide through paint in a paint tray without rotating. As a result, nap 30 fails to pickup a consistent layer of coating material. Inclusion of ribs 22 in the roller core 20/nap 30 assembly provides sufficient resistance when moving across the surface of a paint tray to ensure rotation of roller core 20 and subsequent pickup of coating material by nap 30. Likewise, many surfaces to be treated with coating material are sufficiently smooth to preclude gripping of nap 30 during application of coating material to the surface. The presence of ribs 22 provides additional sliding resistance during application of coating material to the surface. When the user passes paint roller 10 over the surface, the contact of rib 22 forces the rotation of roller core 20 thereby ensuring consistent transfer of coating material from nap 30 to the surface. In initial testing, a user painted two walls with a viscous coating material. The user estimated that use of the current invention reduced painting time by about 30% when compared to the use of the same sized roller lacking ribs 22.

Figure 7:
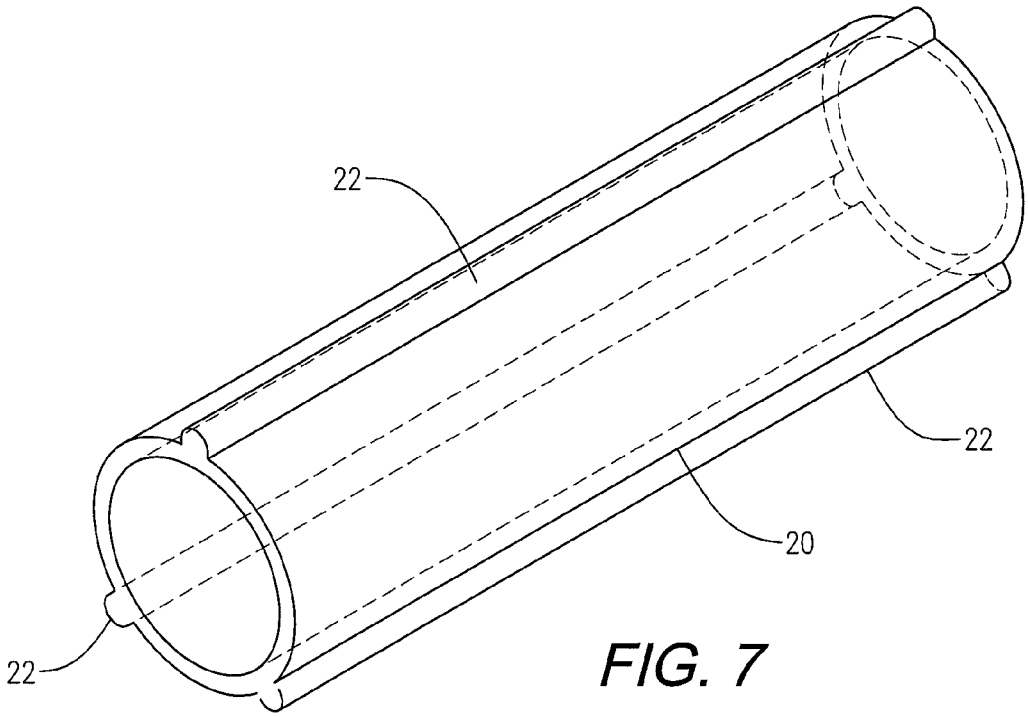
FIG. 7 depicts an alternative embodiment of the improved roller core wherein the core carries three transverse ribs evenly spaced about the circumference of the core.
Figure 8:
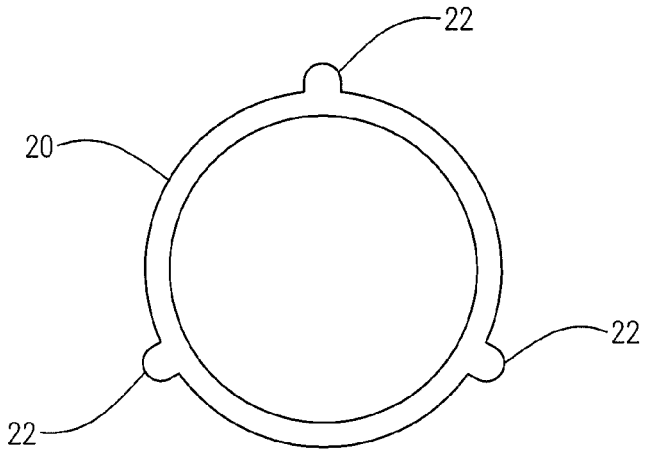
FIG. 8 depicts an end view of the roller core of FIG. 7 with the ribs having a generally rounded configuration.

As depicted in FIGS. 5, 7 and 9, rib 22 on the opposite side of roller core 20 is shown in hidden line mode. In general, the preferred embodiment will have at least two ribs 22. Generally, four ribs 22 as shown in FIGS. 9 and 10 will be sufficient to minimize or reduce sliding of the roller through paint tray thereby adding rolling of roller core 20 and nap 30 through the pan to provide adequate pickup of coating material by nap 30 from the paint tray and subsequent transfer of coating material to a surface. Additionally, ribs 22 will enhance transfer of paint to a surface by minimizing or reducing sliding over the surface. As previously discussed, ribs 22 depicted in FIGS. 11-13 may be discontinuous protrusions and/or shorter than the length of roller core 20. Further, ribs 22 depicted in FIGS. 11-13 may be integral with either roller core 20 or nap 30. Additionally, the ribs may be rigid, flexible or compressible having the heights discussed above. Finally, although depicted with four ribs 22, additional ribs 22 may be added to provide the necessary resistance to induce rolling over smooth surfaces or through dense or slick coating materials within a paint tray.

Other embodiments of the present invention will be apparent to one skilled in the art. As such, the foregoing description merely enables and describes the general uses and methods of the present invention. Accordingly, the following claims define the true scope of the present invention.

What is claimed is:

1. A paint roller comprising:

a roller core having an outer surface and a central axis;

a nap positioned over said outer surface of said roller core;

at least one rib positioned between said outer surface of said roller core and said nap; and, wherein said at least one rib is oriented in a direction generally parallel to said central axis of said roller core, said nap covering at least a portion of said rib.

2. The paint roller of claim 1, wherein said at least one rib runs transversely from one edge of said roller core to the opposing edge of said roller core.

3. The paint roller of claim 1, wherein said at least one rib is a compressible rib.

4. The paint roller of claim 1, wherein said at least one rib is defined by a series of discrete protrusions.

5. The paint roller of claim 1, wherein said at least one rib is four ribs that are equally positioned around said roller core and between said outer surface of said roller core and said nap.

6. The paint roller of claim 1, wherein said at least one rib has a height of about 10% to 100% of the thickness of said nap.

7. The paint roller of claim 1, wherein said roller core further carries at least one groove and said at least one rib is positioned within said groove such that said rib extends above said outer surface of said roller core.

8. The paint roller of claim 7, wherein said groove is configured to support said at least one rib at an angle different from a radial line extending from said central axis of said roller core.

9. A paint roller comprising:

a roller core having an outer surface and a central axis;

a nap positioned over said outer surface of said roller core;

at least one rib positioned within said nap wherein said at least one rib is oriented in a direction generally parallel to said central axis of said roller core.

10. The paint roller of claim 9, wherein said at least one rib passes longitudinally across the length of said outer surface of said roller core.

11. The paint roller of claim 9, wherein said at least one rib runs transversely from one edge of said roller core to the opposing edge of said roller core.

12. A paint roller comprising:

a roller core having an outer surface and a central axis;

a nap positioned over said outer surface of said roller core;

at least one rib integral with said roller core and extending upward from said outer surface of said roller core wherein said at least one rib is oriented in a direction generally parallel to said central axis of said roller core.

13. The paint roller of claim 12, wherein said at least one rib runs transversely from one edge of said roller core to the opposing edge of said roller core.

14. A paint roller comprising:

a roller core having an interior and an outer surface a slot passing through the said roller core, said roller core having a central axis;

a slot in said outer surface, said slot providing communication between the interior and exterior of said roller core and said slot oriented in a direction generally parallel to said central axis;

a nap positioned over said outer surface of said roller core;

at least one flexible rib extending from said interior of said roller core through said slot of said roller core to a position above said outer surface of said roller core and, said at least one flexible rib contacting said nap.

15. The paint roller of claim 14, wherein said slot is configured to support said at least one flexible rib at an angle different from a radial line extending from said central axis of said roller core.

16. The paint roller of claim 14, wherein said slot is at a non-perpendicular angle to said outer surface of said roller core.

17. The paint roller of claim 14, wherein said at least one rib runs transversely from one edge of said roller core to the opposing edge of said roller core.

18. A paint roller comprising:

a roller core having an outer surface and a central axis;

a nap positioned over said outer surface of said roller core;

at least one rib integral with said roller core and extending above said outer surface of said roller core, wherein said at least one rib is oriented in a direction generally parallel to said central axis of said roller core; and, said at least one rib contacting said nap.

19. The paint roller of claim 18, wherein said at least one rib is at an angle different from a radial line extending from said central axis of said roller core.

20. The paint roller of claim 18, wherein said at least one rib runs transversely from one edge of said roller core to the opposing edge of said roller core.

* * * * *